US005605023A

United States Patent [19]

Biernazki

[11] Patent Number: 5,605,023

[45] Date of Patent: Feb. 25, 1997

[54] COMBINED DECORATIVE AND LOAD BEARING ARCHITECTURAL COLUMN FOR BUILDINGS

[75] Inventor: Christian P. Biernazki, White Hall, Md.

[73] Assignee: Fypon Inc., Stewartstown, Pa.

[21] Appl. No.: 272,233

[22] Filed: Jul. 8, 1994

[51] Int. Cl.[6] ..... E04C 3/30

[52] U.S. Cl. ..... 52/301; 52/737.4; 52/737.5; 52/738.1

[58] Field of Search ..... 52/301, 740.7, 52/740.6, 738.1, 737.5, 737.4, 736.4, 736.3, 723.2, 723.1, 721.5, 721.4, 263

[56] References Cited

U.S. PATENT DOCUMENTS

| | | | |
|---|---|---|---|
| 849,951 | 4/1907 | White | 52/737.4 |
| 969,097 | 8/1910 | Ford | 52/301 |
| 973,615 | 10/1910 | Barrick | 52/301 |
| 1,350,686 | 8/1920 | Trudelle | 52/737.4 |
| 1,934,260 | 11/1933 | Dean | 52/301 |
| 3,324,613 | 6/1967 | Duboff | 52/301 |
| 3,421,269 | 1/1969 | Medow | 52/301 |
| 4,216,634 | 8/1980 | Binder | 52/737.4 |
| 4,641,467 | 2/1987 | Dupuis, Jr. | 52/301 |

*Primary Examiner*—Michael Safavi

*Attorney, Agent, or Firm*—Oblon, Spivak, McClelland, Maier & Neustadt, P.C.

[57] ABSTRACT

A reinforced molded plastic column wherein a plastic sleeve having the appearance of a column of natural material is molded about a central load bearing member, preferably a steel pipe, having extending ends engaging and being fastened to anchoring members fixed to a foundation and a roof, respectively. Column base and capital members are slideably carried on the plastic sleeve and when the load bearing member has been secured to the anchor members, the base and capital members are slid over the sleeve until they engage the foundation and roof, to which the base and capital members may be bonded, to disguise the extending ends of the load bearing members.

19 Claims, 1 Drawing Sheet

COMBINED DECORATIVE AND LOAD BEARING ARCHITECTURAL COLUMN FOR BUILDINGS

FIELD OF THE INVENTION

This invention relates to static structures and more particularly to an improved decorative and load bearing column for supporting a roof above a foundation.

BACKGROUND OF THE INVENTION

In prior application Ser. No. 08/170,748 filed Dec. 21, 1993 and assigned to the same assignee as the present application there is disclosed a combined decorative and load bearing architectural column for buildings. That column comprises a central reinforcing load bearing member such as a plastic or steel pipe, clad from end to end in molded foamed plastic having the appearance and substantially the same degree of density, but not the structural strength, and appearance of material usually used for columns such as marble or other stone, wood, etc. The columns are positioned between a roof and a foundation and retained in place primarily by the compressive force of the roof load acting downwardly on the columns. Though this is entirely satisfactory, a question has been raised in areas which are particularly prone to hurricane force winds as to the possibility that winds of great strength may raise a roof clear of the columns sufficiently to permit the columns to be moved by wind force clear of the roof thereby permitting it to collapse. It is the object of the present invention to provide an improved reinforced column wherein a central load bearing unit is clad in molded foam plastic, as in the prior application, yet means are also provided for firmly anchoring the roof through the column to the foundation to resist any tendency for the roof to be lifted clear of the columns.

Other objects and their advantage will become apparent as the following detailed description is read in conjunction with the accompanying drawings wherein:

DETAILED DESCRIPTION OF THE PREFERRED EMBODIMENT

Figure 3:
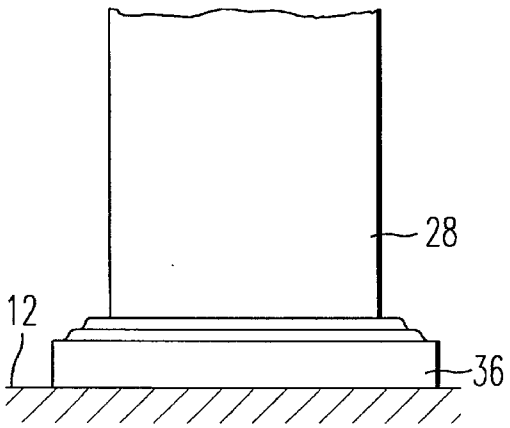
FIG. 3 is an assembled vertical elevational view of the same lower part of the column shown in FIG. 2.

The column 10 shown in the drawings has a length selected to extend between a foundation 12 and a roof 14 as, for example, in a classic portico at the entrance of a building. The column includes an anchor member 16 and means, such as an apertured flange 18 adapted to receive suitable fasteners 20 for rigidly fastening the member 16 to the foundation 14. The anchor member 16 includes a vertical component 22 having a predetermined height and a predetermined cross-sectional configuration.

In accordance with the invention a load bearing unit 24, preferably a steel pipe though it could be a PVC pipe of suitable load bearing capacity, is provided having a length substantially equal to the predetermined finished distance that the roof 14 is spaced above the foundation 12. The load bearing unit 24 has at least a lower end 26 whose cross-sectional configuration is complementary to the cross-sectional configuration of the vertical component 22 of the anchor member 16, one of the lower end 26 of the unit and the vertical component being hollow and slideably receivable within the other whereby the lower end 26 of the load bearing unit is anchored to the foundation. Where the load bearing unit is a pipe, its lower end is naturally hollow and desirably the vertical component 22, which may be solid, has a close sliding fit with the internal surface of the pipe. However, it is within the purview of the invention for the load bearing member to be solid and its lower end could be of reduced cross-sectional size to fit slideably within a hollow vertical component whose internal cross-sectional configuration is complementary to that of the lower end of the load bearing unit.

In common with prior application Ser. No. 08/170,748 mentioned above, a sleeve 28 of foamed plastic material is molded and adhered by known molding techniques to the exterior surface of the load bearing unit 24. The plastic material, which may be polyurethane, or a similar plastic, is admixed with a blowing agent and then confined in a mold surrounding the load bearing unit 24. Because the mold prevents the foaming plastic from expanding, the result is a sleeve of substantial density and, depending on selected additives, may have the appearance of any selected natural material used in the construction of columns and, of course, the sleeve may have any desired external appearance, e.g. be fluted, by selecting a mold to suit.

Figure 1:
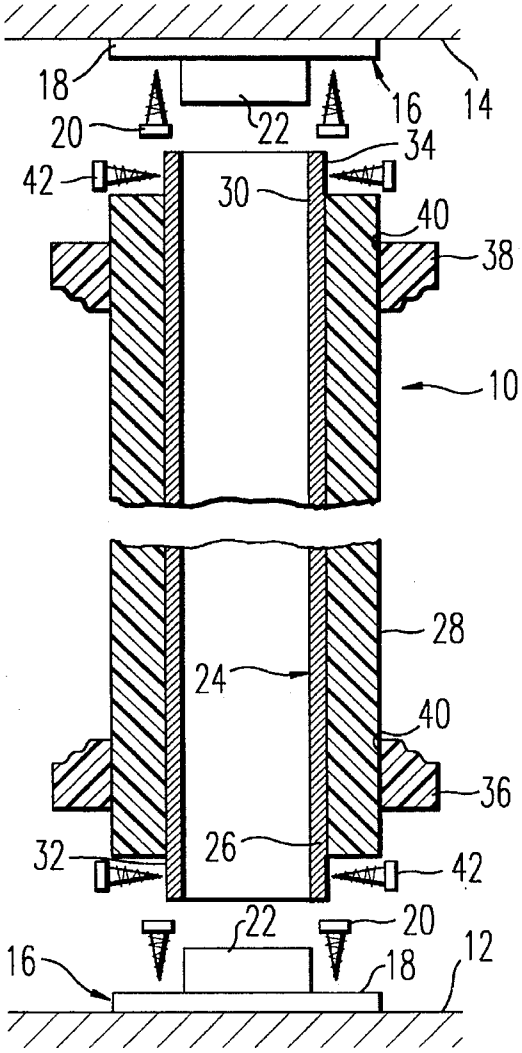
FIG. 1 is a vertical broken, exploded cross-sectional view of a column constructed in accordance with the invention.

In accordance with the invention, and as is apparent in FIG. 1, the sleeve 28 has a length less than the length of the load bearing unit 24 whereby the lower end 26, and also the upper end 30 of the load bearing unit extend freely predetermined distances beyond the corresponding ends of the sleeve 28 to define gaps 32, 34 between the respective ends of the unit 24 and sleeve 28.

Preferably the upper end of the column is anchored to the roof in the same manner as the lower end described above and thus the same reference numerals are used to define like parts for the upper anchor member as for the lower anchor member.

Figure 2:
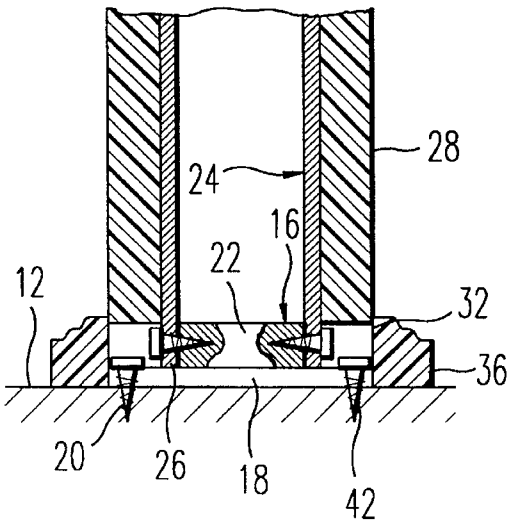
FIG. 2 is an assembled, broken vertical cross-sectional view of the lower part of the column of FIG. 1.

In accordance with the invention, before the column is erected in its place of use, molded base and capital members 36, 38, having central passages 40 therethrough complementary in shape and size to the external surface of the sleeve, are slid over the opposite ends of the sleeve as should be clear in FIG. 1. The central passages 40 have depths greater than the gaps 32, 34 between the ends 26, 30 of the load bearing unit 21 and the sleeve 28 whereby, following installation of the sleeve 28 and load bearing unit 24, the base and capital members 36, 38 are slidable along the sleeve until they respectively engage the foundation 14 and roof 12 thus disguising the gaps 32, 34 as should be clear in FIG. 2, and presenting a finished appearance to the column as should be clear in FIG. 3.

The base and capital members 36, 38 may be bonded to the respective foundation and roof 12, 14 by bonding means such as epoxy. The flanges 18 of the anchoring members 16 have horizontal dimensions not greater than the corresponding dimensions of the lower and upper ends of the sleeve 28 so as to enable the passages 40 through the base and capital members in their positions of use to entirely surround the flange 18 as should be clear in FIG. 2.

In addition to the fastening elements 20 for securing the flanges 18 to the foundation 12 and roof 14, the invention contemplates the use of additional fastening elements 42 for fastening together the extending ends 26, 30 of the load carrying unit 24 and the vertical components 22 of the anchor numbers 16.

In use, the columns and anchor members will be assembled to the foundation and roof to suit the circumstance. Preferably, however, the anchor members 16 will first be screwed by fasteners 20 to the foundation 12 and roof 14, respectively. The roof will, at this stage, be jacked-up sufficiently to permit the lower end 26 of the load bearing members 24 of all the columns to be slid over the vertical components 22 of the lower anchor member 16, after which the extending lower ends 26 of the load bearing members 24 are fastened by fasteners 42 to the vertical components 22 of the lower anchor members. The roof 14 is now carefully lowered until the vertical components 22 of the upper anchor members 16 enter fully into the upper ends 30 of the load bearing members 24 whereupon they are fastened by fasteners 42 to the upper vertical component 22. Following this the base and capital members 36, 38 are slid downwardly and upwardly until they engage and are bonded to the foundation and roof, respectively, whereupon the structure is completed.

Having now described the invention what is claimed is:

1. A combined decorative and load bearing architectural building column of a length to extend between a roof and a foundation, said column comprising:

an anchor member, means for rigidly fastening said anchor member to said foundation, said anchor member including a vertical component having a predetermined height and a predetermined cross-sectional configuration, a load bearing unit having a length substantially equal to the predetermined finished distance that the roof is spaced above the foundation, said unit having at least a lower end whose cross-sectional configuration is complementary to the cross-sectional configuration of the vertical component of said anchor member, one of said lower end of said unit and said vertical component of said anchor member being hollow and slideably receivable within the other such that the lower end of said unit is anchored to said foundation, a sleeve of molded plastic material adhered to the exterior surface of said unit, said plastic material having a density and external appearance of selected material commonly used in the construction of building columns and having a length less than the length of said unit such that the ends of said unit extend freely by predetermined distances beyond ends of said sleeve to define gaps between the respective ends of said unit and said sleeve, means for anchoring the upper free end of said unit to the roof, and a decorative base and capital members slideably received on said sleeve and having central passages complementary to the external surface of the sleeve and a depth greater than said gaps between the end of said unit and said sleeve such that following installation of said unit and said sleeve between said roof and foundation, said base and capital members are slidable along said sleeve until said members respectively engage the foundation and the roof and thereby cover and disguise the respective gaps between the ends of said unit and said sleeve wherein the means for anchoring the upper free end of the unit comprises a second vertical component and wherein at least the upper and lower ends of said unit are hollow and are slideably received over said vertical components.

2. The column of claim 1 wherein said unit is a steel pipe.

3. The column of claim 2 wherein said sleeve is foamed plastic molded to the exterior surface of said pipe.

4. A combined decorative and load bearing architectural building column of a length to extend between a roof and a foundation, said column comprising:

a first anchor member, means for rigidly fastening said first anchor member to said foundation, said first anchor member including a vertical component having a predetermined height and a predetermined cross-sectional configuration, a load bearing unit having a length substantially equal to the predetermined finished distance that the roof is spaced above said foundation, said unit having at least a lower end whose cross-sectional configuration is complementary to the cross-sectional configuration of the vertical component of said first anchor member, one of said lower end of said unit and said vertical component of said first anchor member being hollow and slideably receivable within the other such that the lower end of said unit is anchored to the foundation, a sleeve of molded plastic material adhered to the exterior surface of said unit, said plastic material having a density and external appearance of selected material commonly used in the construction of building columns and having a length less than the length of said unit such that the ends of said unit extend freely predetermined distances beyond ends of said sleeve to define gaps between the respective ends of said unit and said sleeve; and means for anchoring the upper free end of said unit which includes a second anchor member having a vertical component of a predetermined height and means for rigidly fastening said second anchor member to the roof, at least the upper end of said unit and said vertical component of said second anchor member having complementary configurations such that one of said vertical component of said second anchor member and the upper end of said unit is slideably received within the other and wherein at least the upper and lower ends of said unit are hollow and are respectively slideably receivable over said vertical components.

5. The column of claim 4 wherein said anchor members include flanges extending beyond said vertical components, said flanges comprising the means for rigidly fastening said anchor members to said foundation and roof, respectively.

6. The column of claim 5 wherein said flanges have horizontal dimensions not in excess of corresponding dimensions of said sleeve.

7. The column of claim 5, including fastening elements for extending through said flange to rigidly fastener the anchor members to the foundation and roof, respectively.

8. The column of claim 7 including additional fastening elements for fastening together the extending ends of said unit and said vertical components.

9. A combined decorative and load bearing architectural building column of a length to extend between a roof and a foundation, said column comprising:

a first anchor member, a mechanism rigidly fastening said anchor member to the foundation, said first anchor member including a first vertical component having a predetermined height and a predetermined cross-sectional configuration, a load bearing unit having a length substantially equal to the predetermined finished distance that said roof is spaced above the foundation, said unit having at least a lower end whose cross-sectional configuration is complementary to the cross-sectional configuration of the first vertical component of said first anchor member, one of said lower end of said unit and said vertical component of said first anchor member being hollow and slideably receivable within the other such that the lower end of said unit can be anchored to said foundation, a sleeve of molded plastic material adhered to the exterior surface of said unit, said plastic material having a density and external appearance of selected material commonly used in the construction of building columns and having a length less than the length of said unit such that the ends of said unit extend freely predetermined distances beyond ends of said sleeve to define gaps between the respective ends of said unit and said sleeve, a mechanism anchoring the upper free end of said unit to said roof, and a decorative base and capital members slideably received on said sleeve and having central passages complementary to the external surface of the sleeve and depth greater than said gaps between the end of said unit and said sleeve such that, following installation of said unit and said sleeve between said roof and foundation, said base and capital members are slidable along said sleeve until said members respectively engage the foundation and the roof and thereby cover and disguise the respective gaps between the ends of said unit and said sleeve, wherein the mechanism anchoring the upper free end of the unit comprises a second vertical component and wherein at least the lower and upper ends of said unit are hollow and are respectively slideably received over said first and second vertical components.

10. The column of claim 9, wherein said unit comprises a steel pipe.

11. The column of claim 10, wherein said sleeve comprises foamed plastic molded to the exterior surface of said pipe.

12. The column of claim 9, wherein the mechanism anchoring the upper free end of said unit comprises a second anchor member which includes said second vertical component and a mechanism rigidly fastening the second anchor member to said roof, at least the upper end of said unit and said second vertical component of said second anchor member having complimentary configurations such that one of said second vertical component and the upper end of said unit is slideably received within the other.

13. A combined decorative and load bearing architectural building column of a length to extend between a roof and a foundation, said column comprising:

an anchor member, a mechanism rigidly fastening said anchor member to said foundation, said anchor member including first vertical component having a predetermined height and a predetermined cross-sectional configuration, a load bearing unit having a length substantially equal to the predetermined finished distance that the roof is spaced above said foundation, said unit having at least a lower end whose cross-sectional configuration is complementary to the cross-sectional configuration of the first vertical component of said anchor member, one of said lower end of said unit and said first vertical component of said anchor member being hollow and slideably receivable within the other such that the lower end of said unit can be anchored to the foundation, a sleeve of molded plastic material adhered to the exterior surface of said unit, said plastic material having a density and external appearance of selected material commonly used in the construction of building columns and having a length less than the length of said unit such that the ends of said unit extend freely predetermined distances beyond ends of said sleeve to define gaps between the respective ends of said unit and said sleeve, a mechanism anchoring the upper free end of said unit to the roof, and a decorative base and capital members slideably received on said sleeve and having central passages complementary to the external surface of the sleeve and depth greater than said gaps between the end of said unit and said sleeve such that following installation of said unit and said sleeve between the roof and the foundation, said base and capital members are slidable along said sleeve until said members respectively engage the foundation and the roof and thereby cover and disguise the respective gaps between the ends of said unit and said sleeve wherein the mechanism anchoring the upper free end of the unit comprises a second vertical component, wherein at least the upper and lower ends of said unit are hollow and are slideably received over said second and first vertical components respectively, the mechanism anchoring the upper free end of said unit comprises a second anchor member which includes said second vertical component of a predetermined height and a mechanism rigidly fastening said anchor member to the roof, at least the upper end of said unit and said second vertical component have complimentary configurations such that one of said second vertical component and the upper end of said unit is slideably received within the other and wherein at least the upper and lower ends of said unit are hollow and are respectively slideably receivable over said first and second vertical components.

14. The column of claim 13, wherein said anchor members include flanges respectively extending beyond said first and second vertical components, said flanges comprising the mechanism rigidly fastening said anchor members to the foundation and roof, respectively.

15. The column of claim 14, wherein said flanges have horizontal dimensions not in excess of corresponding dimensions of said sleeve so as to enable the passages through said base and capital members, in their positions of use, to entirely surround said flanges.

16. The column of claim 14, which comprises fastening members extending through said flange and rigidly fastening said anchor members to the foundation and roof, respectively.

17. The column of claim 16, which comprises additional fastening elements respectively fastening together the extending ends of said units and said first and second vertical components.

18. The column of claim 13, wherein said unit comprises a steel pipe.

19. The column of claim 18, wherein said sleeve comprises foamed plastic molded to the exterior of said pipe.

* * * * *